US005572222A

United States Patent [19]

Mailandt et al.

[11] Patent Number: 5,572,222

[45] Date of Patent: Nov. 5, 1996

[54] MICROSTRIP PATCH ANTENNA ARRAY

[75] Inventors: Peter Mailandt, Dallas; Tan D. Huynh, Hurst, both of Tex.

[73] Assignee: Allen Telecom Group, Solon, Ohio

[21] Appl. No.: 514,132

[22] Filed: Aug. 11, 1995

Related U.S. Application Data

[63] Continuation of Ser. No. 83,030, Jun. 25, 1993, abandoned.

[51] Int. Cl.[6] ..... H01Q 1/38

[52] U.S. Cl. ..... 343/700 MS

[58] Field of Search ..... 343/700 MS; H01Q 1/38

[56] References Cited

U.S. PATENT DOCUMENTS

| | | | |
|---|---|---|---|
| Re. 29,911 | 2/1979 | Munson | 343/700 MS |
| Re. 32,369 | 3/1987 | Stockton et al. | 342/368 |
| 3,681,769 | 8/1972 | Perrotti et al. | 343/814 |
| 3,921,177 | 11/1975 | Munson | 343/846 |
| 4,012,741 | 3/1977 | Johnson | 343/700 MS |
| 4,054,874 | 10/1977 | Oltman, Jr. | 343/700 MS |
| 4,070,676 | 1/1978 | Sanford | 343/700 MS |
| 4,131,892 | 12/1978 | Munson et al. | 343/700 MS |
| 4,131,893 | 12/1978 | Munson et al. | 343/700 MS |
| 4,131,894 | 12/1978 | Schiavone | 343/700 MS |
| 4,218,682 | 8/1980 | Yu | 343/700 MS |
| 4,320,401 | 3/1982 | Schiavone | 343/700 MS |
| 4,442,590 | 4/1984 | Stockton et al. | 29/571 |
| 4,464,663 | 8/1984 | Lalezari et al. | 343/700 MS |
| 4,477,813 | 10/1984 | Weiss | 343/700 MS |
| 4,660,048 | 4/1987 | Doyle | 343/700 MS |
| 4,684,952 | 8/1987 | Munson et al. | 343/700 MS |
| 4,686,535 | 8/1987 | Lalezari | 343/700 MS |
| 4,719,470 | 1/1988 | Munson | 343/700 |
| 4,724,443 | 2/1988 | Nysen | 343/700 MS |
| 4,736,454 | 4/1988 | Hirsch | 455/129 |
| 4,766,440 | 8/1988 | Gegan | 343/700 MS |
| 4,775,866 | 10/1988 | Shibata et al. | 343/700 MS |
| 4,816,836 | 3/1989 | Lalezari | 343/700 MS |
| 4,821,040 | 4/1989 | Johnson et al. | 343/700 MS |
| 4,825,220 | 4/1989 | Edward et al. | 343/700 MSX |
| 4,835,538 | 5/1989 | McKenna et al. | 343/700 MS |
| 4,835,539 | 5/1989 | Paschen | 343/700 MS |
| 4,835,541 | 5/1989 | Johnson et al. | 343/713 |
| 4,843,400 | 6/1989 | Tsao et al. | 343/700 MS |
| 4,893,129 | 1/1990 | Kodera et al. | 343/700 MS |
| 4,914,445 | 4/1990 | Shoemaker | 343/700 MS |
| 5,010,348 | 4/1991 | Rene et al. | 343/700 MS |
| 5,061,944 | 10/1991 | Powers et al. | 343/795 |
| 5,165,109 | 11/1992 | Han et al. | 343/700 MS |
| 5,274,391 | 12/1993 | Connolly | 343/789 X |
| 5,309,164 | 5/1994 | Dienes et al. | 343/700 MS |
| 5,400,041 | 3/1995 | Strickland | 343/700 MS |

FOREIGN PATENT DOCUMENTS

| | | | |
|---|---|---|---|
| 2471679 | 6/1981 | France | 343/700 MS |
| 63-46804 | 2/1988 | Japan | H01Q 1/38 |

OTHER PUBLICATIONS

Pozar et al, "A Rigorous Analysis of Microstripline Fed Patch Antenna", pp. 1343–1348, Dec. 1987.

Harvey, "Parallel–Plate Transmission Systems for Microwave Frequencies", Mar. 1959, pp. 129–139.

Johnson et al, *Antenna Engineering Handbook*, 1984(no month), pp. 7–1 – 7–27.

1989 International Symposium Digest Antennas and Propagaion, vol. II, Jun. 1989, pp. 604–607, Benalla et al. "Multiport Network Model for Microstrip Patches Covered With A Dielectric Layer".

IEEE Transactions on Antennas and Propagation, vol. 40, No. 8, Aug. 1992, pp. 950–958, Potharazu et al. "Analysis and Design of a Leaky–Wave EMC Dipole Array".

*Primary Examiner*—Donald T. Hajec

*Assistant Examiner*—Steven Wigmore

*Attorney, Agent, or Firm*—Dressler, Goldsmith Milnamow & Katz, Ltd.

[57] ABSTRACT

A microstrip patch antenna array incorporating a plurality of spaced-apart patch radiating elements electromagnetically coupled to a microstrip line conductively coupled to a source of signals. Both the spaced-apart patch radiating elements and the microstrip line are located on the same side of an adjacent conductive substrate. The microstrip patch radiating elements are arranged in a linear co-planar array electromagnetically excited by the field created by the air substrated microstrip line passing adjacent thereto.

19 Claims, 2 Drawing Sheets

FIG. 3
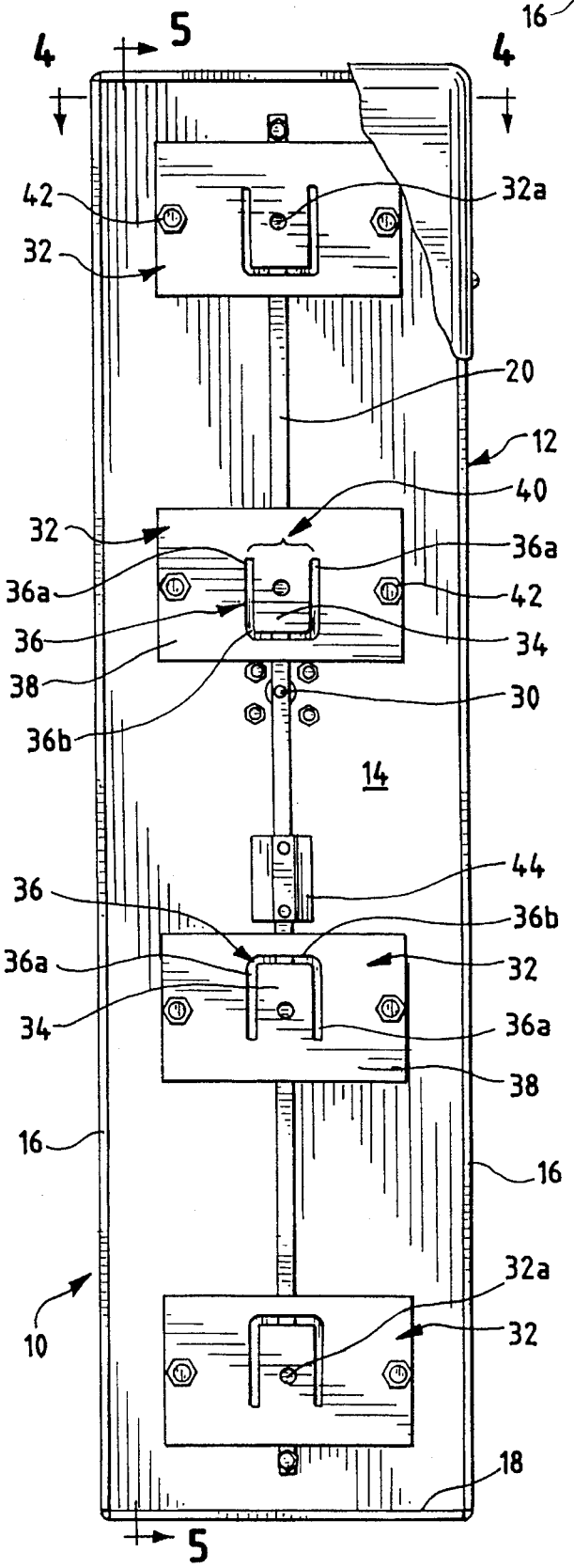
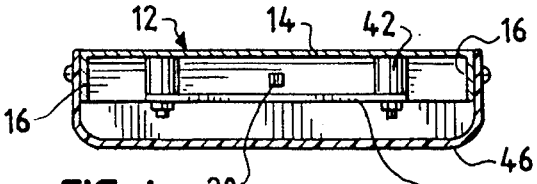
FIG. 4
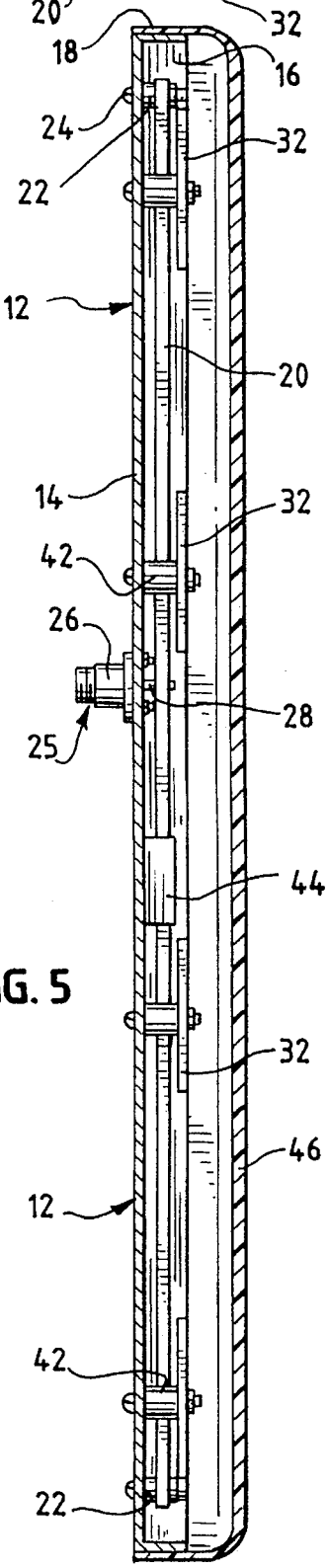
FIG. 5

MICROSTRIP PATCH ANTENNA ARRAY

This application is a continuation of application Ser. No. 08/083,030, filed Jun. 25, 1993, now abandoned.

FIELD OF THE INVENTION

The present invention relates to antennas and more particularly to microstrip patch antenna arrays for use in wireless antenna telecommunications.

BACKGROUND OF THE INVENTION

Microstrip patch antennas are desirable structures for use in wireless telecommunications, particularly in view of their compactness, conformability, and general ease of fabrication. One major disadvantage of such structures has been a narrow bandwidth. A variety of approaches have been utilized in an effort to expand the bandwidth of such structures.

For example, it is known that bandwidth can be increased by increasing the thickness of the microstrip antenna patch substrate, or by introducing parasitic elements of varying size above and/or below the driven element. The addition of parasitic elements stacked above and/or below the driven element to increase the bandwidth is less desirable in some cases because of the physical structure that is required.

It would be desirable therefore to produce a microstrip antenna structure that would provide the desired broad bandwidth without the disadvantage of having a physical structure that creates a problem respecting the ability to mount it on various support structures or becomes too large in size.

SUMMARY OF THE INVENTION

In accordance with the present invention, there is disclosed a microstrip patch antenna array incorporating a plurality of spaced-apart patch radiating elements which are electromagnetically coupled to a microstrip line which is connected to a source of signals through an appropriate cable connection. Both the spaced-apart patch radiating elements and the microstrip line are located on the same side of an adjacent conductive substrate. The microstrip patch radiating elements are arranged in a linear co-planar array electromagnetically excited by the field created by the air substrated microstrip line passing adjacent thereto.

By utilizing the electromagnetic coupling between the microstrip line and the microstrip patch radiating elements, the configuration and structure of the antenna array incorporating the present invention can be considerably simplified, and the cost of construction reduced.

In an antenna array incorporating the present invention, a microstrip line, conductively connected to a feed line such as a coaxial cable, is disposed on one side of a conductive substrate which typically acts as a ground plane element and is spaced therefrom. An array of microstrip patch radiating elements are spaced apart one from the other and disposed on the opposite side of the microstrip line from the ground plane and spaced therefrom. The microstrip patch elements are electromagnetically excited by the fringing field produced by the microstrip line and are not conductively connected thereto.

Typically, each of the spaced-apart radiating elements is rectangular in shape. A generally central U-shaped slot formed in each of the microstrip patch radiating elements separates each radiating element into a radiating portion, and a coupling portion. The microstrip line passes on one side of each of the patch radiating elements, and directly beneath the inner coupling portions of each microstrip patch element.

The patches can be configured to be excited for 90° azimuth 3 db beam width or 60° azimuth 3 db beam width. For a 90° azimuth 3 db beam width, the sides of each rectangular patch element oriented generally parallel to the microstrip line and disposed on either side thereof are longer than the sides interconnecting them and traversing the microstrip line. For a 60° azimuth 3 db beam width, the sides of each rectangular patch element oriented generally parallel to the microstrip line are shorter than the sides interconnecting them and traversing the microstrip line.

More specifically, the antenna array incorporating the present invention utilizes a co-planar array of a plurality of radiating elements each divided into a generally centrally disposed coupling portion and an outer radiating portion surrounding the coupling portion. The two portions are formed and separated by a generally U-shaped slot with the boundary therebetween extending between the free ends of the U-shaped slot. The base of the U-shaped slot is oriented transverse to the microstrip line and extends thereover with the microstrip line passing under and generally bisecting the coupling portion of each radiating patch element.

The width of the coupling portion, the distance from the boundary area to the adjacent edge of the radiating element, the spacing between the microstrip line and the ground plane all contribute to defining the characteristic input impedance for each of the radiating elements and the antenna array.

A feed cable, such as a coaxial cable, is connected to the elongated microstrip line at a feed point located intermediate its ends. When the orientation of the microstrip patch radiating elements on one side of the feed point is opposite to the orientation of the microstrip patch radiating elements on the other side of the feed point, the microstrip patch radiating elements are spaced from the feed point by distances generally equal to an odd number of quarter wavelengths for the center frequency at which the antenna array is intended to operate so as to produce signals in phase. When the orientation of the microstrip patch radiating elements on one side of the feed point is the same as the orientation of the microstrip patch radiating elements on the other side of the feed point, the microstrip patch radiating elements are spaced from the feed point by distances generally equal to an odd number of half wavelengths for the center frequency at which the antenna array is intended to operate so as to produce signals in phases. The exact positions may vary depending upon a number of factors, including the size and/or shape of the patch radiating elements.

By electromagnetically coupling the microstrip line to the radiating elements, the entire structure can be disposed internally of the ground plane and enclosed therein. A minimum amount of direct electrical connections and components requiring such connections are utilized. The relative position of the components can be defined relative to the feed point along the length of the microstrip line. An additional impedance matching element can be attached to the microstrip line intermediate one or more pairs of the microstrip patches in order to provide for any necessary impedance adjustment.

A microstrip patch antenna array incorporating the present invention operating in the 1.6–2.1 GHz frequency range exhibits at a VSWR below 1.3:1 over a bandwidth of about 200–300 Mhz and a twenty percent (20%) bandwidth for VSWR below about 1.5:1. An antenna having such a bandwidth is particular suitable for use in the new personal communication applications operating at these frequency ranges and is capable of providing and interacting with signals over a desired bandwidth.

Antennas incorporating the present invention are capable of operating at a total power of 200–250 watts in the 1.6–2.1 GHz frequency range, and can be readily mounted on any suitable support structure such as a mast or the surface of any structure. The utilization in antennas incorporating the present invention of electromagnetic coupling and the location of substantially all of the components thereof on the same side of the ground plane provides for a compact efficient structure capable of a wide range of uses.

Numerous other features and advantages of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 3 is a plan view of the antenna array of FIG. 1 with the cover broken away;

FIG. 4 is a sectional view taken along the line 4—4 of FIG. 3; and FIG. 5 is a section view taken along the line 5—5 of FIG. 3.

DESCRIPTION OF THE PREFERRED EMBODIMENT

Figure 1:
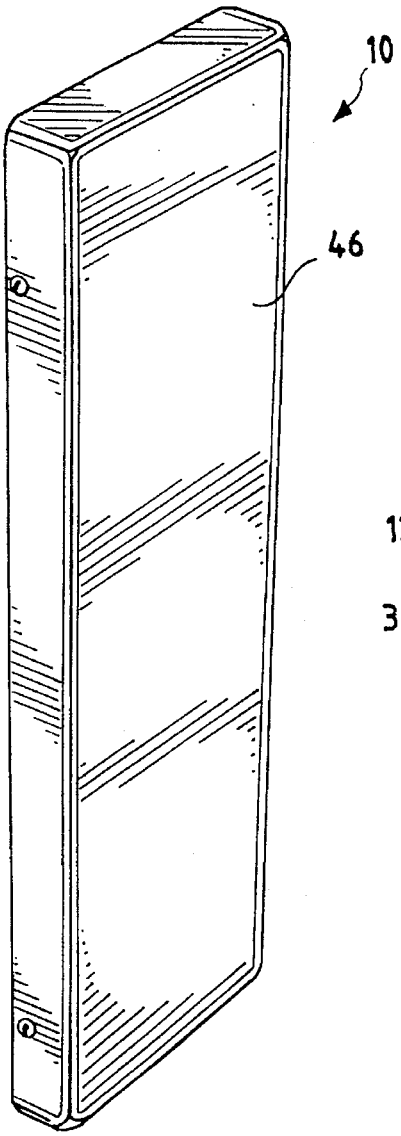
FIG. 1 is a perspective view of an antenna array incorporating the present invention with a cover in place.
Figure 2:
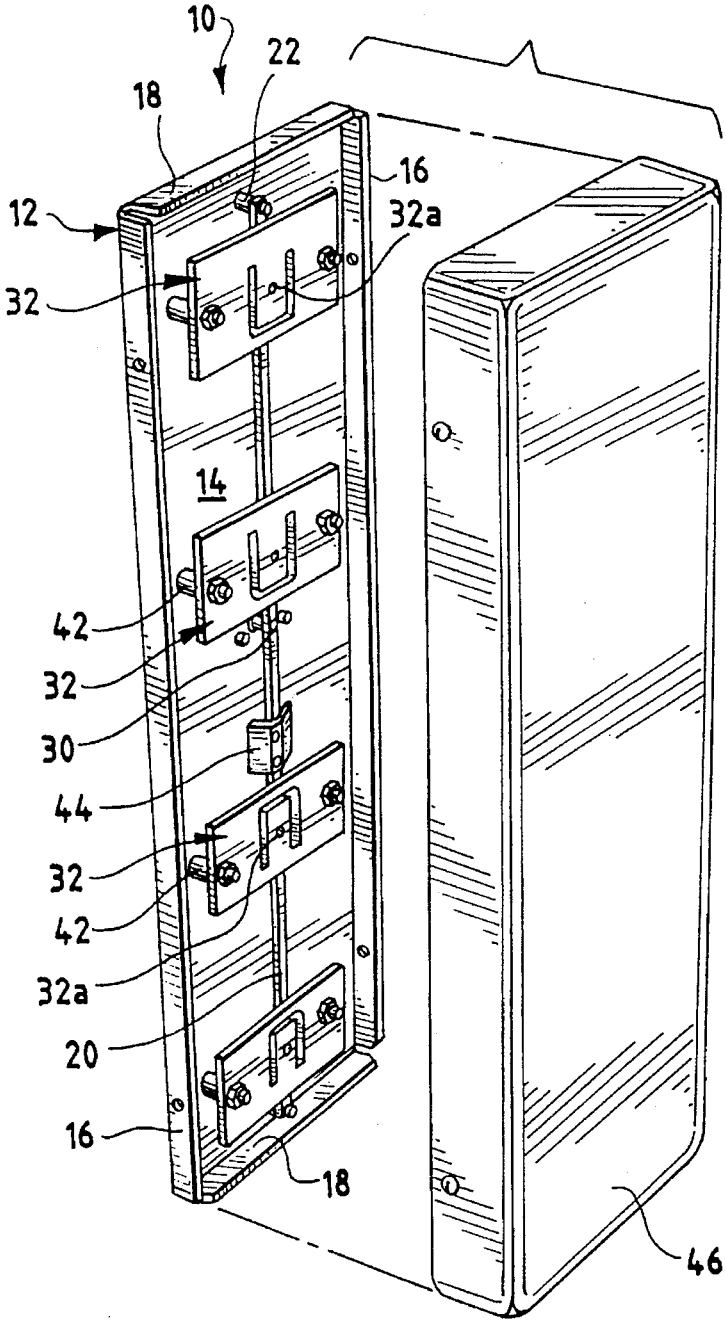
FIG. 2 is an exploded perspective view of the antenna array of FIG. 1 with the cover removed therefrom.

A microstrip patch antenna array 10 incorporating the present invention includes a conductive substrate 12 which acts as a ground plane for the array. The conductive substrate 12 includes a generally rectangular base portion 14, a pair of raised side walls 16 extending up from the opposite sides thereof, and a pair of raised end walls 18 extending up from the opposite ends thereof.

The antenna array 10 includes a generally rigid, elongated microstrip line 20 extending substantially the length of the conductive substrate 12 and which is spaced away from the base portion 14 by conductive spacers 22 located at either end thereof. Suitable fasteners 24 passing through the base of the conductive substrate or ground plane and the spacers 22 retain the microstrip line 20 in place.

The microstrip line 20 is centered between the side walls 16 and extends generally along the center line of the conductive substrate 12. The antenna array 10 is connected to a suitable transceiver (not shown) by means of an appropriate cable such as a coaxial cable. The cable may pass directly through the base of the conductive substrate 12 for connection to the microstrip line 20 or may be connected to a coaxial connector 25 having an outer or shield contact or conductor 26 attached to and electrically connected to the conductive substrate and a center contact or conductor 28 passing through and insulated from the conductive substrate 12 and connected to the microstrip line 20 at feed point 30.

A plurality of microstrip patch radiating elements 32 are disposed along the length of the microstrip line 20 and are centered with respect thereto. Each of the microstrip patch radiating elements 32 is formed as a rectangle having a generally centrally located coupling portion 34 defined by a U-shaped slot 36 having legs **36*a* and a base 36*b*, and an outer radiating portion 38 surrounding the coupling portion 34. The boundary 40 between the coupling portion 34 and the radiating portion 38 extends between the free ends of the legs 36*a* of the U-shaped slot 36**.

The coupling portion 34 of each of the patch radiating elements 32 is located and centered over the microstrip line 20 and is generally bisected thereby. The base **36*b* of the U-shape cut-out 36 traverses the microstrip line 20, and the legs 36*a*** extend parallel thereto on either side thereof and are equally spaced therefrom.

The microstrip patch radiating elements 32 are disposed on the opposite side of the microstrip line 20 from the conductive substrate 12 and are supported in position by suitable insulated spacers 42, there being a pair of spacers for each patch radiating element 32. An impedance adjusting component or tuning member 44 is attached to the microstrip line 20 between the feed point 30 and an adjacent one of the patch radiating elements 32.

The feed point 30 is spaced from the center **32*a* of each of the patch radiating elements 32 by an odd integral number of quarter-wave lengths to provide correct phase coupling between the microstrip line 20 and each of the patch radiating elements 32. In the embodiment shown in the drawing, the bases 36*b* of the U-shaped slots 36 for each of the patch radiating elements on either side of the connection point are oriented closest to the feed point 30. In this configuration, the distance between the feed point 30 and the center 32*a* of each of the patch radiating elements 32** is an odd number of quarter-wave lengths; and the difference between the distance on either side of the connection point differing by one-half wavelength in order that all of the patch radiating elements are excited in phase.

Thus, the distance between the center **32*a* of the closest patch radiating element and the feed point 30 is approximately one-quarter of a wavelength, and the distance between the feed point 30 and the center 32*a* of the closest patch radiating element on the other side of the feed point is about three-quarters of a wavelength. The inter-element spacing between the patch radiating elements, the distance between the centers 32*a***, on each side of the connection point is approximately one wavelength.

It should be appreciated if either pair of the patches is reversed so that all the boundaries are in the same relative position, the positions would have to be adjusted by a half wave-length in order to maintain the proper phase.

The input impedance of the antenna array can be slightly adjusted by an the adjusting or tuning member 44 which is shown as a metal plate approximately one inch square disposed between the feed point 30 and one of the adjacent patch radiating elements 36. The impedance is adjusted by bending the plate 44 towards and away from the conductive substrate 12 until the proper tuning can be achieved. Typically, the plate is oriented at about a 45° angle on either side of the microstrip line although the location and angle does not appear to be critical.

All of the components of the antenna array 10 can be enclosed by a suitable non-conductive cover 46, typically made of plastic, which may also serve the purpose of protecting the antenna array and its components from the effects of exposure to weather after installation. The shape of the cover is not critical and can be selected to provide a pleasant and decorative appearance.

In one embodiment of a microstrip patch antenna array incorporating the present invention adapted for use in the frequency range of between about 1.6 GHz and about 2.1 GHz, the components were constructed with the following dimensions.

The microstrip line 20 was constructed from a 0.19 inch square metal rod and had a length of about 23.3 inches. The feed point 30 was located about 10 inches from one end and about 13.3 inches from the other.

Each of the rectangular patch radiating elements 32 was constructed from a metal sheet having a thickness of about 0.062 inch and a dimension of about 2.60 inches by about 4.0 inches, with the shorter sides extending parallel to the microstrip feed line 20. The width of the coupling portion of each of the rectangular patch radiating elements 32 was about 0.875 inch and the distance between the boundary 40 and the adjacent edge of the radiating element was about 0.8 inch. The spacing between the boundaries 40 of the patch radiating elements was about 6.6 inches.

The spacing between the microstrip feed line and the conductive substrate 12 was about 0.335 inch and the spacing between each of the patch radiating elements 32 and the conductive substrate 12 was about 0.675 inch.

An antenna so constructed for use in the frequency range set forth above exhibited a VSWR less than 1.5:1 over a bandwidth of at least about twenty percent (20%) and a VSWR less than 1.3:1 over bandwidth in excess of 200 MHz or in excess of about sixteen percent (16%).

Thus, there has been disclosed a microstrip patch antenna array in which all of the components are disposed internally of the structure and can be protected from the elements by virtue of an appropriate cover in which a single conductive connection is provided for coupling the transceiver to the antenna array and in which the radiating microstrip patch elements are electromagnetically excited by the fringing field created by the air substrated microstrip line running between and extending between the patches and the adjacent conductive substrate.

The excited patch radiating elements produce and radiate the energy into free space with the desired bandwidth characteristics to enable the antenna incorporating the present invention to be used in a variety of applications. For example, the microstrip patch antenna array incorporating the present invention is particularly useful for operation in conjunction with personal communications networks (PCN), in the 1.6–2.1 frequency range, or for cellular wireless mobile communications in the 800–1000 MHz frequency range.

From the foregoing, it will be observed that numerous modifications may be effected without departing from the true spirit and scope of the novel concept of the invention. It should be understood that no limitation with respect to the specific apparatus illustrated herein is intended or should be inferred. It is, of course, intended to be covered by the appended claims, and all such modifications as fall within the scope of the appended claims.

What is claimed is:

1. A microstrip patch antenna array comprising:

a conductive substrate;

a continuous conductive elongated microstrip line of finite length extending entirely along a straight line, having opposed ends, and spaced from said conductive substrate;

a connector having a conductor connected to said elongated microstrip line at a feed point located intermediate the ends thereof;

a plurality of generally rectangular patch radiating elements disposed at selected positions along the length of said microstrip line on the side of said microstrip line opposite from said conductive substrate, each of said patch radiating elements having a width and length greater than the width of said microstrip line and including a coupling portion disposed generally centrally thereof and having a peripheral edge, and an outer radiating portion surrounding said coupling portion, said coupling portion being physically separated from said radiating portion by an elongate slot extending along a substantial portion of said peripheral edge thereof, said coupling portion being connected to said radiating portion at a boundary therebetween, each of said patch radiating elements being spaced one from the other and insulated from said conductive substrate and from said microstrip line and positioned adjacent to said microstrip line with said microstrip line disposed underneath a portion of said elongate slot of each of said patch radiating elements, and with said coupling portion of each of said patch radiating elements being disposed over said elongated microstrip line, for electromagnetic excitation therefrom in response to a signal applied to said microstrip line at said feed point, and said coupling portion, said elongate slot, and outer radiating portion of each of said patch radiating elements being disposed on either side of said elongated microstrip line.

2. A microstrip patch antenna array as claimed in claim 1 wherein said conductive substrate acts as a ground plane.

3. A microstrip patch antenna array as claimed in claim 1 wherein the ends of said elongated microstrip conductive line are conductively connected to said conductive substrate.

4. A microstrip patch antenna array as claimed in claim 1 wherein said coupling portion of each of said patch radiating elements is positioned to be bisected by said elongated microstrip line.

5. A microstrip patch antenna array as claimed in claim 1 wherein the distance from the center of each of said patch radiating elements to the center of an adjacent one of said patch radiating elements is approximately equal to one wavelength for the operating frequency range of said microstrip patch antenna array.

6. A microstrip patch antenna array as claimed in claim 1 including an even number of said patch radiating elements wherein half of said radiating elements are disposed on one side of said feed point and the remaining elements are disposed on the other side of said feed point.

7. A microstrip patch antenna array as claimed in claim 6 wherein the orientation of said patch radiating elements on one side of said feed point is reversed from the orientation of said patch radiating elements on the other side of said feed point.

8. A microstrip patch antenna array as claimed in claim 7 wherein the distance from the feed point to the boundary between the coupling and radiating portions of the patch radiating elements is about equal to an odd number of one-quarter wavelengths.

9. A microstrip patch antenna array as claimed in claim 8 wherein the distance between the feed point and the two closest ones of said radiating elements differs by about one-half wavelength.

10. A microstrip patch antenna array as claimed in claim 1 including a tuning member disposed along and connected to said elongated microstrip line and disposed between said feed point and one of the two closest ones of said radiating elements and immediately adjacent an edge thereof.

11. A microstrip patch antenna array as claimed in claim 10 wherein said tuning member is disposed in part below said radiating elements.

12. A microstrip patch antenna array as claimed in claim 1 wherein the sides of said patch radiating elements oriented generally parallel to said elongated microstrip line are approximately one-half wavelength.

13. A microstrip patch antenna array as claimed in claim 1 in which the spacing between said elongated microstrip line and said conductive substrate is greater than the spacing between said elongated microstrip line and said patch radiating elements.

14. A microstrip patch microstrip antenna array as claimed in claim 1 wherein said antenna is adapted for use at frequencies between about 1.6 GHz and about 2.1 Ghz.

15. A microstrip patch antenna array as claimed in claim 14 wherein the dimension of the sides of said patch radiating elements oriented generally parallel to said elongated microstrip line is about 2.6 inches, and said patch radiating elements are constructed from a metal sheet having a thickness of about 0.062 inch.

16. A microstrip patch antenna array as claimed in claim 15 in which the distance between the elongated microstrip feed line and said conductive substrate is about 0.335 inch and the distance between each of said radiating elements and said ground plane is about 0.675 inch.

17. A microstrip patch antenna array as claimed in claim 16 in which the width of said coupling portion of each of said patch radiating elements is about 0.875 inch, and the boundary between the coupling portion and said radiating portion is about 0.8 inch from the adjacent edge of said patch radiating element.

18. A microstrip patch antenna as claimed in claim 17 in which said antenna array exhibits a bandwidth of approximately 20% with a VSWR no greater than 1.5:1.

19. A microstrip patch antenna array as claimed in claim 1 in which the spacing between said elongated microstrip line and said conductive substrate is less than the spacing between said conductive substrate line and said patch radiating elements.

* * * * *